US009545769B2

(12) United States Patent
Schieder et al.

(10) Patent No.: US 9,545,769 B2
(45) Date of Patent: Jan. 17, 2017

(54) ASSEMBLY FOR PRODUCING AN ENDLESS SINGLE-FACE LAMINATED WEB OF CORRUGATED CARDBOARD

(71) Applicant: BHS Corrugated Maschinen- und Anlagenbau GmbH, Weiherhammer (DE)

(72) Inventors: Sebastian Schieder, Letzau (DE); Florian Müller, Weiherhammer (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 34 days.

(21) Appl. No.: 14/527,014

(22) Filed: Oct. 29, 2014

(65) Prior Publication Data

US 2015/0122423 A1 May 7, 2015

(30) Foreign Application Priority Data

Nov. 4, 2013 (DE) ..... 10 2013 222 282

(51) Int. Cl.
*B31F 1/28* (2006.01)

(52) U.S. Cl.
CPC ..... *B31F 1/2831* (2013.01); *B31F 1/2818* (2013.01); *B31F 1/2836* (2013.01); *B31F 1/2845* (2013.01); *B31F 1/2877* (2013.01)

(58) Field of Classification Search
None
See application file for complete search history.

(56) References Cited

U.S. PATENT DOCUMENTS 5,344,520 A 9/1994 Seki et al.
5,518,457 A 5/1996 Seki et al.
5,951,817 A 9/1999 Thomas
(Continued)

FOREIGN PATENT DOCUMENTS

DE 691 10 845 T2 11/1995
DE 694 15 975 T2 8/1999
(Continued)

OTHER PUBLICATIONS

European Search Report of Feb. 2, 2015.

*Primary Examiner* — Barbara J Musser
(74) *Attorney, Agent, or Firm* — McGlew and Tuttle, P.C.

(57) ABSTRACT

The invention relates to an assembly for producing a web of corrugated cardboard. The assembly has a corrugating device for producing a corrugated web, a glue application device for applying glue to the corrugated web and a pressure belt device which has an endless pressure belt guided around a deflection roller and a belt course regulating roller for pressing a cover layer against the corrugated web provided with glue. The pressure belt device has at least one pressure belt detection device associated to the pressure belt, the pressure belt detection device comprising a first pressure belt detection means for detecting the position of a first outer endless side edge of the pressure belt in the transverse direction thereof, a pressure belt regulating device in signal communication with the pressure belt detection device and an actuating device connected to the belt course regulating roller displacement device for displacing the belt course regulating roller depending on the regulating signals received from the pressure belt regulating device.

21 Claims, 4 Drawing Sheets

(56) References Cited

U.S. PATENT DOCUMENTS

2008/0308233 A1* 12/2008 Nitta ..... B31F 1/2836
156/472

FOREIGN PATENT DOCUMENTS

| | | | |
|---|---|---|---|
| EP | 0 387 242 | A1 | 9/1990 |
| EP | 0 492 310 | A1 | 7/1992 |
| EP | 0 698 752 | A2 | 2/1996 |
| WO | 99/08866 | A1 | 2/1999 |

* cited by examiner

ASSEMBLY FOR PRODUCING AN ENDLESS SINGLE-FACE LAMINATED WEB OF CORRUGATED CARDBOARD

CROSS-REFERENCE TO RELATED APPLICATIONS

This application claims the priority of patent application Ser. No. DE 10 2013 222 282.3 filed on 4 Nov. 2013, pursuant to 35 U.S.C. 119(a)-(d), the content of which is incorporated herein by reference in its entirety as if fully set forth herein.

FIELD OF THE INVENTION

The invention relates to an assembly for producing an endless single-face laminated web of corrugated cardboard.

BACKGROUND OF THE INVENTION

Assemblies of the generic type are already known from prior art, the assemblies comprising pressure belts for pressing a cover web to a corrugated web provided with glue. The belt course of the pressure belt is generally settable in advance. A drawback of these assemblies is that the pressure belts are subjected to extremely high wear during operation which greatly reduces the service life thereof. Furthermore, complications relating to the pressure belts occur frequently in the production of the webs of corrugated cardboard which affects the performance of the entire installation.

SUMMARY OF THE INVENTION

An object of the invention is to overcome the drawbacks from prior art. In particular, an assembly shall be provided which comprises a pressure belt device the pressure belt of which has a particularly long service life and allows endless webs of corrugated cardboard to be produced without complications.

According to the invention, this object is achieved by an assembly for producing an at least single-face laminated endless web of corrugated cardboard, comprising a first corrugating roller and a second corrugating roller for producing a corrugated web having a corrugation; a glue application device for applying glue to tips of the corrugation of the corrugated web, and a pressure belt device comprising a deflection roller; a belt course regulating roller; an endless pressure belt guided around the deflection roller and the belt course regulating roller for pressing a cover layer against the tips, provided with glue, of the corrugated web partly abutting against the first corrugating roller, the pressure belt comprising a first outer endless side edge; a second outer endless side edge arranged opposite to the first outer endless side edge; a direction of rotation, and a transverse direction running transversely to the direction of rotation; a belt course regulating roller displacement device for displacing the belt course regulating roller, a position of the pressure belt being changeable in the transverse direction thereof by displacing the belt course regulating roller; at least one pressure belt detection device associated to the pressure belt for detecting the position of the pressure belt in its transverse direction, the pressure belt detection device comprising a first pressure belt detection means for detecting the position of the first outer endless side edge of the pressure belt in the transverse direction thereof; a pressure belt regulating device which is in signal communication with the pressure belt detection device and receives positional information concerning the position of the pressure belt in the transverse direction thereof; and at least one actuating device connected to the belt course regulating roller displacement device for displacing the belt course regulating roller depending on regulating signals received from the pressure belt regulating device. The gist of the invention is that the assembly comprises at least one pressure belt detection device which is able to detect, preferably continuously, the current position, strictly speaking the current course, of the driven pressure belt in the transverse direction thereof. The positional information thus obtained concerning the current position of the pressure belt in the transverse direction thereof are processed in the pressure belt regulating device which, if necessary, then displaces the pressure belt regulating roller by means of the belt course regulating roller displacement device by actuating the at least one actuating device. As such the pressure belt is transversely displaceable from its actual position into its desired position. If necessary, it is thus displaced in a direction transverse to its direction of rotation.

The first pressure belt detection means is ideally capable of directly detecting the position of the first outer endless side edge of the pressure belt in the transverse direction thereof. Alternatively, for instance a region of the pressure belt spaced from the first outer endless side edge, said region for instance comprising at least one mark, marking or the like, is detectable by the first pressure belt detection means, thus allowing the position of the first outer endless side edge of the pressure belt to be detected indirectly in the transverse direction thereof by means of the first pressure belt detection means.

The pressure belt regulating device is preferably an electric, more preferably an electronic, pressure belt detecting device.

The first corrugating roller and the second corrugating roller are preferably arranged in pairs in a machine frame where they are rotatably or rotatably drivably mounted. Together, they form a corrugating device. A web of material is passed through between the corrugating rollers, the web of material being provided with corrugations by means of the corrugating rollers.

The belt course regulating roller displacement device for instance allows the belt course regulating roller to be tilted relative to the deflection roller to change the course of the pressure belt in the transverse direction thereof. Preferably, the distance of the belt course regulating roller from the deflection roller is changeable as well in order to change the tension of the pressure belt.

It is advantageous if the belt course regulating roller displacement device comprises a mounting unit for mounting the belt course regulating roller. Ideally, the belt course regulating roller displacement device further exhibits a lever assembly which is directly or indirectly connected to the mounting unit.

The belt course regulating roller displacement device is adjustable or actuable by at least one actuating device. The at least one actuating device preferably engages the lever assembly. It is preferably a piston cylinder unit, a motor, a drive or the like. The at least one actuating device therefore forms at least one actuator.

It is advantageous if the deflection roller and/or the belt course regulating roller is heatable or heated during operation.

The pressure belt device comprises—as already mentioned—a deflection roller. At least one deflection roller, preferably one or two deflection roller(s), are provided in the pressure belt device.

The pressure belt is closed in its direction of rotation. It is endless and preferably has a constant width in its transverse direction. The pressure belt is driven in its direction of rotation.

Preferably, the pressure belt device is placed above the corrugating rollers. Alternatively, the pressure belt device is arranged at a side of the corrugating rollers such that the rollers of the pressure belt device are substantially arranged one above the other.

The signal communication between the pressure belt regulating device and the pressure belt detection device is wireless or wired. Preferably, a signal communication provided between the pressure belt regulating device and the actuating device is wireless or wired as well.

It is advantageous if the assembly for producing an at least single-face laminated endless web of corrugated cardboard is part of a corrugated cardboard installation.

In an assembly which is provided with a contactless pressure belt detection device, neither the pressure belt detection device nor the pressure belt are subjected to mechanical wear during operation which results in a particularly high service life of the pressure belt device. Furthermore, a pressure belt detection device of this type is extremely precise during its entire service life.

Ideally, the pressure belt detection device is an optical, inductive or capacitative pressure belt detection device. An optical pressure belt device is preferably configured as a camera, sensor, light gate, light grid or light curtain.

A pressure belt which includes metal material and is preferably made thereof substantially entirely is particularly resistant to wear. Furthermore, it ensures an extremely even and secure transmission of forces to the cover web, which results in an extremely secure bonding between the corrugated web and the cover web. Ideally, the pressure belt is substantially entirely made of a fabric, more preferably of a metal fabric. Alternatively, the pressure belt is preferably made of a suitable plastic material or a resilient material such as rubber. For instance, the pressure belt is also made of thin steel such as spring steel and does not have any openings in its pressure belt surface. An air-permeable pressure belt is however preferred. An inductive pressure belt detection device then further allows conclusions to be drawn concerning the material properties of the pressure belt and, consequently, the behaviour thereof.

According to a preferred embodiment, the pressure belt comprises at least one identifier detectable by the pressure belt detection device, preferably at least one identification thread, for setting at least one parameter required for said pressure belt, ideally by means of the belt course regulating roller displacement device, more preferably by means of the belt tensioning displacement device or the actuating device thereof. It is advantageous if the at least one identifier is substantially arranged inside the pressure belt. For instance, the at least one identifier is formed by at least one identification thread woven into the pressure belt. The at least one identifier preferably extends in the direction of rotation of the pressure belt. It may be closed in the circumferential direction of the pressure belt and is preferably arranged adjacent to the first and/or second side edge of the pressure belt. Another assembly, for instance perpendicular or at an angle to the first and/or second side edge, is for instance conceivable as well. The at least one parameter is preferably a rotational speed of the pressure belt, heating of the pressure belt, transverse orientation of the pressure belt and/or a tension of the pressure belt.

The embodiment in which the first pressure belt detection means extends above or below a first outer endless side edge region of the pressure belt adjoining the first outer endless side edge and extends beyond the first endless outer side edge in a laterally outward direction for detecting a prevailing first overlap with the pressure belt, the first pressure belt detection means preferably extending in the transverse direction of the pressure belt, provides a particularly simple and secure manner of detecting a transverse offset of the pressure belt in the transverse direction thereof. The first pressure belt detection means is preferably arranged above or below the pressure belt relative to its pressure belt surface. It is advantageous if the first pressure belt detection means extends parallel to the pressure belt surface of the adjacent portion of the pressure belt. Ideally, the first pressure belt detection means has a distance from the pressure belt in a direction perpendicular to its adjacent pressure belt surface which is between 5 mm and 30 mm, more preferably between 10 mm and 20 mm.

The embodiment in which the pressure belt detection device comprises a second pressure belt detection means for detecting the position of the second outer endless side edge of the pressure belt in the transverse direction thereof provides a particularly simple and secure manner of detecting a transverse offset of the pressure belt in the transverse direction thereof.

The embodiment in which the second pressure belt detection means preferably extends above or below a second outer endless side edge region of the pressure belt adjoining the second outer endless side edge while extending beyond the first outer endless side edge in a laterally outward direction for detecting a prevailing second overlap with the pressure belt results in an extremely precise and secure pressure belt detection device as well. Corresponding to the first pressure belt detection means, the second pressure belt detection means is preferably arranged above or below the pressure belt relative to the pressure belt surface thereof. Ideally, the second pressure belt detection means extends parallel to the pressure belt surface of the adjacent portion of the pressure belt. Ideally, the second pressure belt detection means has a distance from the pressure belt, strictly speaking from the adjacent pressure belt surface thereof, which is between 5 mm and 30 mm, more preferably between 10 mm and 20 mm.

Ideally, the second pressure belt detection means is capable of directly detecting the position of the second outer endless side edge of the pressure belt in the transverse direction thereof. Alternatively, for instance a region of the pressure belt spaced from the first outer endless side edge, said region for instance comprising at least one mark, marking or the like, is detectable by the second pressure belt detection means, thus allowing the position of the second outer endless side edge of the pressure belt to be detected indirectly in the transverse direction thereof by means of the second pressure belt detection means.

The aforementioned explanations substantially apply accordingly to the embodiment in which the second pressure belt detection means extends in the transverse direction of the pressure belt.

The arrangement of the pressure belt detection means such that the first pressure belt detection means and the second pressure belt detection means are arranged on an imaginary straight line which runs in the transverse direction of the pressure belt again provides an extremely simple and secure manner of detecting the position of the pressure belt or the side edges thereof.

The embodiment in which the pressure belt regulating device calculates an actual width B of the pressure belt in the transverse direction thereof on the basis of the positional information concerning the two detected outer endless side edges so as to actuate and/or displace the pressure belt on the basis of the calculated width B, the pressure belt regulating device preferably actuating and/or displacing the pressure belt depending on the calculated width B, minimizes the risk of complications during production of a web of corrugated cardboard and operation of the pressure belt device. Based on the determined actual current width of the pressure belt, the pressure belt regulating device is able to detect a shrinking or expansion of the pressure belt in the transverse direction thereof.

According to a preferred embodiment, the pressure belt regulating device determines the service life stage, in other words the current amount of wear of the pressure belt, on the basis of the actual width B of the pressure belt in the transverse direction thereof.

Ideally, the pressure belt regulating device actuates and/or displaces the pressure belt depending on the calculated width or the determined amount of wear. The pressure belt regulating device in particular sets the rotational speed, heating, transverse orientation and/or tension of the pressure belt accordingly. In other words, the pressure belt regulating device adapts the parameters for the pressure belt preferably specifically to the detected service life cycle of the pressure belt. As such the pressure belt regulating device is for instance preferably able to determine whether the pressure belt is in a running-in service life stage, a substantially stationary service life stage and/or in a replacement service life stage. When the replacement service life stage is detected, the pressure belt regulating device preferably emits a replacement signal or a corresponding warning.

The embodiment in which the pressure belt regulating device calculates the actual width B of the pressure belt from a known distance x of the two pressure belt detection means from each other in the transverse direction of the pressure belt and from the actual overlaps of the two pressure belt detection means with the pressure belt provides an extremely precise and simple manner of determining the current width or actual width of the pressure belt.

According to a preferred embodiment, a difference of the two overlaps of the pressure belt detection means with the pressure belt results in a transverse offset of the pressure belt in the transverse direction thereof. As such the transverse offset is determinable in an extremely simple, secure and precise manner.

The embodiment in which the pressure belt regulating device actuates the at least one actuating device in such a way that the difference of the two overlaps of the pressure belt detection means with the pressure belt equals zero so that preferably a center regulation of the pressure belt is carried out allows the pressure belt to be aligned in the transverse direction thereof particularly precisely. Preferably, the direction of rotation of the pressure belt runs centrally between the pressure belt detection means such that a pressure belt center regulation takes place in the transverse direction of the pressure belt.

The assembly in which exactly one belt course regulating roller and exactly one deflection roller are provided, the belt course regulating roller being tiltable relative to the deflection roller to change the course of the pressure belt in the transverse direction thereof while the distance thereof from the deflection roller is changeable for changing the tension in the pressure belt, is extremely simple. The pressure belt is preferably guided around a total of exactly two rollers, namely the belt course regulating roller and the deflection roller.

In the embodiment in which exactly one belt course regulating roller and two deflection rollers are provided, the belt course regulating roller being tiltable relative to the deflection rollers for changing the course of the pressure belt in the transverse direction thereof while a distance between the deflection rollers is changeable for changing the tension in the pressure belt, the pressure belt is ideally guided around a total of exactly three rollers, namely the belt course regulating roller and the two deflection rollers. It is advantageous if the deflection rollers are always parallel to each other. Ideally, the belt course regulating roller is arranged between the deflection rollers. The distance of the deflection rollers relative to each other is adjustable to change the tension of the pressure belt. To this end, exactly one of the deflection rollers is ideally displaceable in a direction perpendicular to its axis of rotation. Alternatively, both deflection rollers are displaceable in a direction perpendicular to their respective axis of rotation.

Preferred embodiments of the invention will hereinafter be described by way of example with reference to the attached drawing.

DESCRIPTION OF THE PREFERRED EMBODIMENTS

Figure 1:
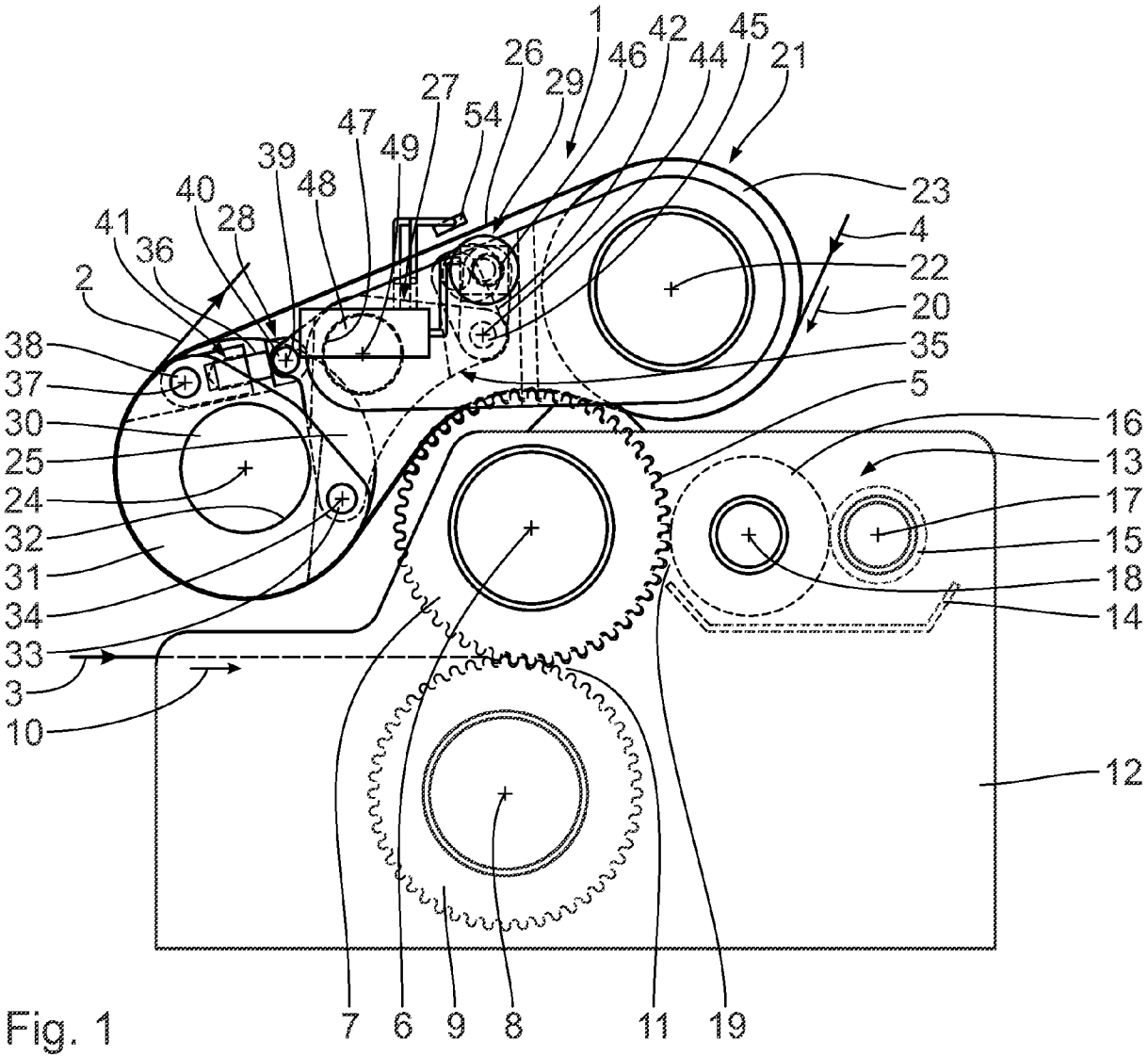
FIG. 1 shows a side of an inventive assembly according to a first embodiment.
Figure 2:
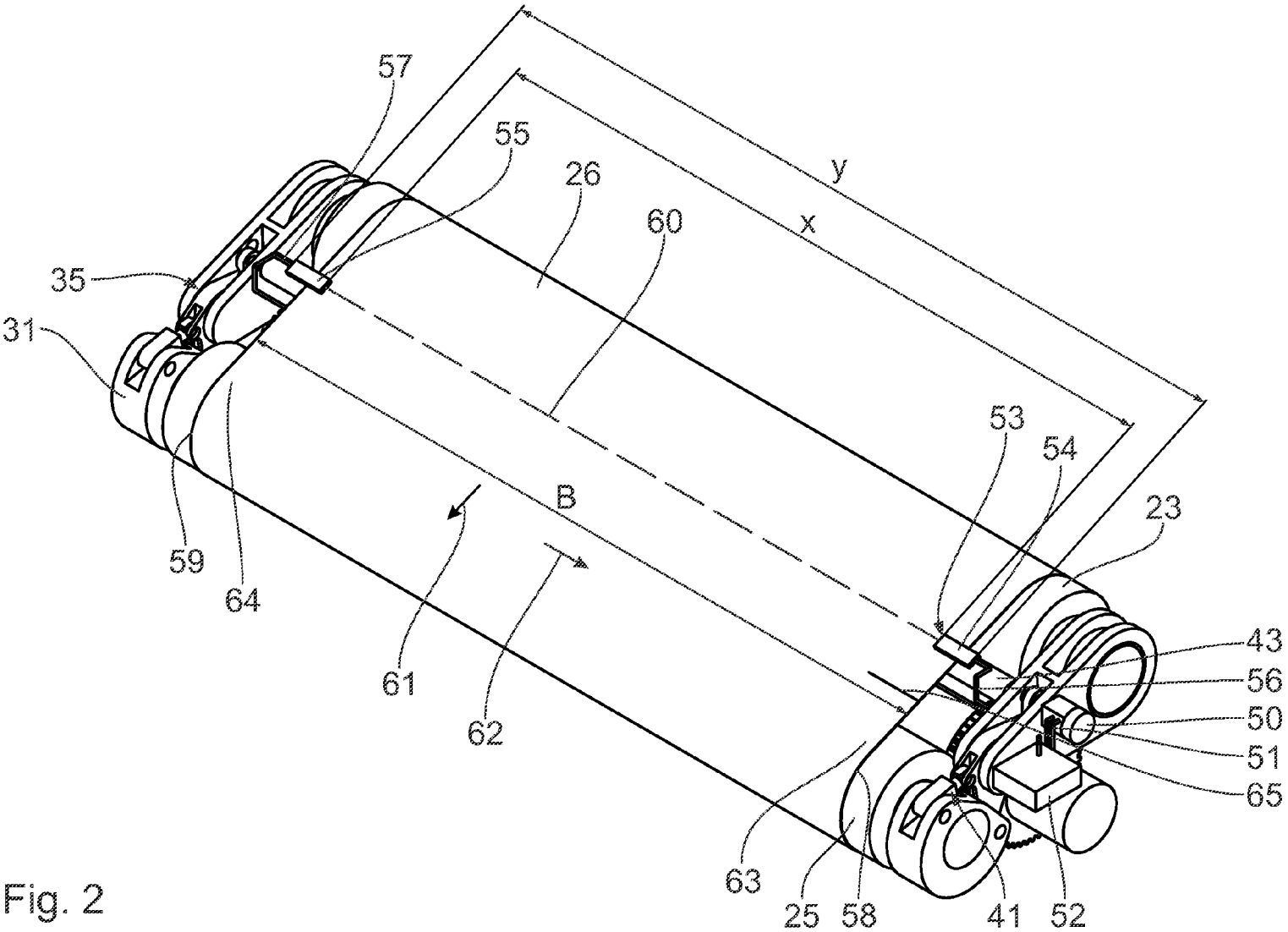
FIG. 2 shows a substantially perspective view of the pressure belt device of the assembly shown in FIG. 1.

Initially referring to the embodiment shown in FIGS. 1 and 2, a corrugated cardboard installation not shown in its entirety comprises an assembly 1 for producing an endless single-face laminated web 2 of corrugated cardboard. A first splice device (not shown) and a second splice device (not shown) are arranged upstream of the assembly 1 for producing the endless single-face laminated web 2 of corrugated cardboard.

In order to unwind a non-endless first material web from a first material web roll, the first splice device comprises a first unwinding unit and a second unwinding unit in order to unwind a non-endless second material web from a second material web roll. The non-endless first and second material webs are joined together by means of a joining and cutting unit (not shown) of the first splice device in order to provide an endless first material web 3. Each time a non-endless first material web is joined to a non-endless second material web, a first joint (not shown) is produced in the endless first material web 3.

The second splice device corresponds to the first splice device. Said second splice device has a third unwinding unit in order to unwind a non-endless third material web from a third material web roll, and a fourth unwinding unit in order to unwind a non-endless fourth material web from a fourth material web roll. The non-endless third and fourth material webs are joined together by means of a joining and cutting unit (not shown) of the second splice device in order to produce an endless second material web 4. Each time a third material web is joined to a fourth material web, a second joint (not shown) is produced in the endless second material web 4.

The endless first material web 3 and the endless second material web 4 are supplied to the device 1 for producing the single-face laminated endless web 2 of corrugated cardboard separately from each other via deflection rollers (not shown).

In order to produce from the endless first material web 3 an endless corrugated web 5 that is provided with a corrugation, the assembly 1 for producing the single-face laminated endless web 2 of corrugated cardboard comprises a first corrugating roller 7 which is mounted for rotation about a first axis of rotation 6, and a second corrugating roller 9 which is mounted for rotation about a second axis of rotation 8. The axes of rotation 6, 8 are parallel to each other and perpendicular to a transport direction of the endless first material web 3. The corrugating rollers 7, 9 together form a roller gap 11 allowing the endless first material web 3 to be passed through in order to be provided with a corrugation.

The corrugating rollers 7, 9 are mounted for rotation in a fixed machine frame 12 of the assembly 1 for producing the endless single-face web 2 of corrugated cardboard.

In order to join the corrugated web 5 to the endless second material web 4 so as to form the single-face laminated web 2 of corrugated cardboard, the assembly 1 for producing the single-face laminated web 2 of corrugated cardboard has a glue application device 13 arranged downstream of the corrugating rollers 7, 9 relative to the first material web 3 or the corrugated web 5. The endless second material web 4 then forms a cover layer. The glue application device 13 in turn comprises a glue tray 14, a glue metering roller 15 arranged in the glue tray 14 as well as a glue application roller 16 arranged in the glue tray 14. The glue application roller 16 is arranged between the glue metering roller 15 and the first corrugating roller 7. The glue metering roller 15 and the glue application roller 16 are mounted for rotation and have third and fourth axes of rotation 17, 18, respectively, which extend parallel to each other and to the axes of rotation 6, 8.

The glue application roller 16 and the first corrugating roller 7 together form a gap 19 allowing the corrugated web 5 to be passed through in order to be provided with a glue layer, with the gap 19 thus forming a gluing gap. Glue (not shown) provided in the glue tray 14 is then applied to free tips of the corrugation of the corrugated web 5 transported in the transport direction 10 via the glue application roller 16 which is immersed in said gluing gap and rotates about the fourth axis of rotation 18. The glue metering roller 15 is arranged substantially opposite to the first corrugating roller 7 and adjacent to the glue application roller 16, thus ensuring that an even glue layer is formed on the glue application roller 16. Said glue application roller 16 then rotates about its third axis of rotation 17.

The glue application roller 16 and the glue metering roller 15 are drivable for rotation by means of a drive belt (not shown) so as to be rotatably driven during operation.

In the assembly 1 for producing the single-face laminated endless web 2 of corrugated cardboard, the corrugated web 5 provided with glue is then joined to an endless second material web 4 transported in the transport direction 20 in order to obtain the endless web 2 of corrugated cardboard. The assembly 1 for producing the single-face laminated endless web 2 of corrugated cardboard has a pressure belt device 21 for pressing the endless second material web 4 against the corrugated web 5 provided with glue which partly abuts against the first corrugating roller 7. Relative to the corrugated web 5, the pressure belt device 21 is arranged downstream of the glue application device 13 and the roller gap 11. The pressure belt device 21 is disposed above the first corrugating roller 7.

The pressure belt device 21 has a, in particular exactly one, deflection roller 23 mounted for rotation about a fifth axis of rotation 22 and a, in particular exactly one, belt course regulating roller 25 mounted for rotation about a sixth axis of rotation 24 as well as a driven endless pressure belt 26 which is guided around the deflection roller 23 and the pressure belt regulating roller 25. When the belt course regulating roller 25 is not tilted, the axes of rotation 23, 24 are parallel to each other. In this case, they are also parallel to the axes of rotation 6, 8.

The first corrugating roller 7 partly engages a space between the deflection roller 23 and the belt course regulating roller 25, thus causing the pressure belt 26 to be deflected by the first corrugating roller 7. It presses against the endless second material web 4 which is thus pressed against the corrugated web 5 provided with glue, the corrugated web 5 abutting against the first corrugating roller 7.

The distance of the belt course regulating roller 25 from the deflection roller 23 is evenly changeable. It is also tiltable relative to the deflection roller 23 about a tilting point which is preferably disposed in the center of its sixth axis of rotation 24. To this end, the pressure belt device 21 is provided with a belt course regulating roller displacement device 27 which in turn exhibits a belt tensioning displacement device 28 for tensioning the pressure belt 26 by evenly changing the distance of the belt course regulating roller 25 from the deflection roller 23, and a belt course regulating displacement device 29 for changing the course or the position of the pressure belt 26 by tilting the belt course regulating roller 25 relative to the deflection roller 23.

The belt course regulating roller 25 has two near-end bearing pins 30 arranged opposite to each other which have a circular or annular cross-section. Each bearing pin 30 is mounted for rotation about a sixth axis of rotation 24 in a bearing body 31 comprising a bearing opening 32 adapted to the respective bearing pin 30, the axis of rotation 24 thus also forming a bearing axis or central longitudinal axis. Each bearing body 31 is articulated to a lever component 35 via a pivot body 33 defining a first pivot axis 34. The bearing bodies 31 are configured identically. The lever components 35 are configured identically as well.

Furthermore a length-adjustable belt tensioning actuating means 36 is functionally arranged between each bearing body 31 and the associated lever component 35. Preferably, the belt tensioning actuating means 36 are telescopable. Each belt tensioning actuating means 36 is articulated to the respective bearing body 31 via a coupling body 38 defining a second pivot axis 37. In each bearing body 31, the pivot bodies 33 and the coupling bodies 38 are spaced from the bearing opening 32 and from each other. Furthermore each belt tensioning actuating means 36 is articulated to the respective lever component 35 via a coupling body 40 defining a third pivot axis 39. Furthermore, in each lever component 35, the pivot bodies 33 are spaced from the coupling bodies 40. The pivot axes 34, 37, 39 are parallel to each other. The two belt tensioning actuating means 36 together form a belt tensioning actuating device 41.

When the two belt tensioning actuating means 36 are actuated evenly, the bearing bodies 31 and the belt course regulating roller 25 mounted therein are pivoted relative to the lever components 35 about the first pivot axis 34. This results in a change in tension of the pressure belt 26. When the belt course regulating roller 25 is moved away from the deflection roller 23, the tension in the pressure belt 26 is increased. Conversely, when the belt course regulating roller 25 is moved towards the deflection roller 23, the tension in the pressure belt 26 is reduced. This also influences the belt course.

The two lever components 35 are substantially coupled to each other via coupling members 42 and a synchronous shaft 43. In each case one of the coupling members 42 is articulated to a respective one of the lever components 35 via a coupling part 45 defining a fourth pivot axis 44. The fourth pivot axes 44 of each lever component 35 are arranged at a distance from the third pivot axes 39 of the belt tensioning actuating means 36. Each coupling member 42 is engaged by a connection means 46 the end portion of which is rigidly connected to the synchronous shaft 43 and runs eccentrically to the synchronous shaft central longitudinal axis thereof. The connection means 46 are configured in the manner of pins and arranged at opposite ends of the synchronous shaft 43. The connection means 46 are arranged in a common symmetry plane which also runs through the synchronous shaft central longitudinal axis. They have an identical distance from the synchronous shaft central longitudinal axis and have connection center axes running at a distance from or offset to each other. The fourth pivot axes 44 of the coupling parts 45, the synchronous shaft central longitudinal axis and the connection center axes are parallel to each other and parallel to the pivot axes 34, 37, 39 whenever a regulation process is or is not performed.

Each lever component 35 is provided with a bearing opening 47 between the third and fourth pivot axes 39, 44. Each bearing opening 47 is engaged by a bearing body 48 to define a fifth pivot axis 49 for the respective lever component 35. The fifth pivot axes 49 are fixed and run parallel to the first pivot axes 34 when no regulation takes place. The bearing body 48 is arranged at an adjacent bearing means in which the deflection roller 23 is mounted for rotation.

The synchronous shaft 43 is pivotable about its synchronous shaft central longitudinal axis by means of a pivot drive 50 which is directly or indirectly coupled with the synchronous shaft 43. Pivoting the synchronous shaft 43 about its synchronous shaft central longitudinal axis in turn causes the two connection means 46 connected thereto to be displaced about the synchronous shaft central longitudinal axis. Owing to the coupling between the connection means 46 and the coupling members 42, the latter are then pivoted about the coupling parts 45, strictly speaking about the fourth pivot axes 44 thereof. The coupling parts 45 are in turn articulated to the two lever components 35. Owing to the coupling of the two lever components 35 via the synchronous shaft 43, the two lever components 35 are pivoted relative to each other in opposite directions, causing the belt course regulating roller 25 to be tiled about the tilting point. The connection means 46 and lever components 35 are pivoted to equal extents in terms of their absolute values. In other words, if one lever component 35 is moved upwards, this causes the other lever component 35 to be moved downwards by the same distance because of the coupling provided therebetween.

The pivot drive 50 is in signal communication with a pressure belt regulating device 52 via a signal line 51, the pivot drive 50 thus forming a belt course actuating device. The pressure belt regulating device 52 is further in signal communication with the belt tensioning actuating means 36 via a signal line (not shown).

The pressure belt device 21 further comprises a pressure belt detection device 53. The pressure belt detection device 53 in turn comprises a first pressure belt detection means 54 and a second pressure belt detection means 55 which is identical to the first pressure belt detection means 54. The first pressure belt detection means 54 is in signal communication with the pressure belt regulating device 52 via a signal line 56 while the second pressure belt detection means 55 is in signal communication with the pressure belt regulating device 52 via a signal line 57.

The pressure belt detection means 54, 55 are arranged adjacent to a first or second side edge 58, 59, respectively, of the pressure belt 26. The side edges 58, 59 are arranged opposite to each other and are in each case endless. Each of the pressure belt detection means 54, 55 is arranged above the first or second side edge 58, 59, respectively, of the pressure belt 26. They are arranged opposite to each other on an imaginary straight line 60 which is perpendicular to a direction of rotation 61 of the pressure belt 26 and perpendicular to the side edges 58, 59. Alternatively, the first and/or second pressure belt detection means 54 and/or 55 is/are arranged below the first and second side edge 58, 59, respectively, of the pressure belt 26.

Between the pressure belt detection means 54, 55, there is a known inner or minimum distance x in a transverse direction 62 of the pressure belt 26, the transverse direction 62 being perpendicular to the direction of rotation 61 thereof. The distance x is fixed. The distance x is smaller than the width B of the pressure belt 26 in the transverse direction 62 thereof. Furthermore, there is an outer or maximum distance y between the pressure belt detection means 54, 55 which is greater than the width B of the pressure belt 26 in the transverse direction 62 thereof and therefore also greater than the inner distance x.

The pressure belt detection means 54, 55 are directly arranged above or, alternatively, below the respective side edge 58 or 59. Starting from the respective side edge 58, 59, they run towards and away from each other, thus allowing changes in the width of the pressure belt 26 in the transverse direction 62 to be detected as well. As such the pressure belt detection means 54, 55 also detect side edge regions 63 and 64, respectively, of the pressure belt 26 adjoining the side edges 58, 59 as well as laterally outer free regions adjoining the side edges 58, 59.

The pressure belt detection means 54, 55 are arranged at the pressure belt 26 substantially opposite to the first corrugating roller 7 between the deflection roller 23 and the belt course regulating roller 25. In other words, they are associated to the upper run of the pressure belt 26. Another location at the pressure belt 26 is alternatively conceivable as well.

Between the first pressure belt detection means 54 and the first side edge region 63, there is a first overlap in the transverse direction 62 while there is a second overlap in the transverse direction 62 between the second pressure belt detection means 55 and the second side edge region 64.

Each of the pressure belt detection means 54, 55 detects the current overlap of the edges with the pressure belt 26. Via the signal lines 56 and 57, said overlap is transmitted to the pressure belt regulating device 52 in the form of corresponding signals where said signals are processed. The pressure belt regulating device 52 continuously calculates the difference between the two overlaps thus detected with the pressure belt 26.

When said difference amounts to zero, the pressure belt 26 is in its desired position. In other words, it is in its target position. It is then not necessary to change the position of the pressure belt 26.

When the detected overlaps with the pressure belt 26 are different, then the pressure belt 26 is laterally offset to its desired position. The difference then amounts to a value which is not equal to zero. This is detected by the pressure belt regulating device 52 which then displaces the belt course regulating roller 25 by means of the belt tensioning displacement device 38 and/or the belt course regulating displacement device 29 by actuating the belt tensioning actuating means 36 or the pivot drive 50, respectively, until the pressure belt 26 is in its desired position again.

If for instance the first overlap with the pressure belt 26 near the first pressure belt detection means 54 is greater than the second overlap with the pressure belt 26 near the second pressure belt detection means 55, then the pressure belt 26 has moved too far in the direction of the first pressure belt detection means 54. The belt course regulating roller 25 is then displaced until the pressure belt 26 is in its desired position again which is closer to the second pressure belt detection means 55. The same applies if the second overlap with the pressure belt 26 near the second pressure belt detection means 55 is smaller than the first overlap with the pressure belt 26 near the first pressure belt detection means 54.

If, however, the second overlap with the pressure belt 26 near the second pressure belt detection means 55 is greater than the first overlap with the pressure belt 26 near the first pressure belt detection means 54, then the pressure belt 26 has moved too far in the direction of the second pressure belt detection means 55. The belt course regulating roller 25 is then displaced until the pressure belt 26 is in its desired position again which is closer to the first pressure belt detection means 54. The same applies if the first overlap with the pressure belt 26 near the first pressure belt detection means 54 is smaller than the second overlap with the pressure belt 26 near the second pressure belt detection means 55.

Preferably, the desired position of the pressure belt 26 is a position in which the pressure belt 26 runs straight in the center between the two pressure belt detection means 54, 55 when seen in the direction of rotation 61.

In the first side edge region 63, an identification thread 65 runs parallel to the adjacent first side edge 58. The identification thread 65 only runs along a part of the circumference of the pressure belt 26 in the circumferential direction 61 thereof. Said identification thread 65 is detectable by the first pressure belt detection means 54. The identification thread 65 is characteristic of the pressure belt 26 currently used. This information is processed in the pressure belt regulating device 52 which preferably actuates the belt course regulating roller displacement device 27 and the belt tensioning displacement device 28 depending on the pressure belt 26 currently used.

Alternatively or in addition thereto, an identification thread runs parallel to the adjacent second side edge 59 in the second side edge region 64. Said identification thread is detectable by the second pressure belt detection means 55. The identification thread is characteristic of the pressure belt 26 currently used. This information is processed in the pressure belt regulating device 52 which preferably actuates the belt course regulating roller displacement device 27 depending on the pressure belt 26 currently used.

Figure 3:
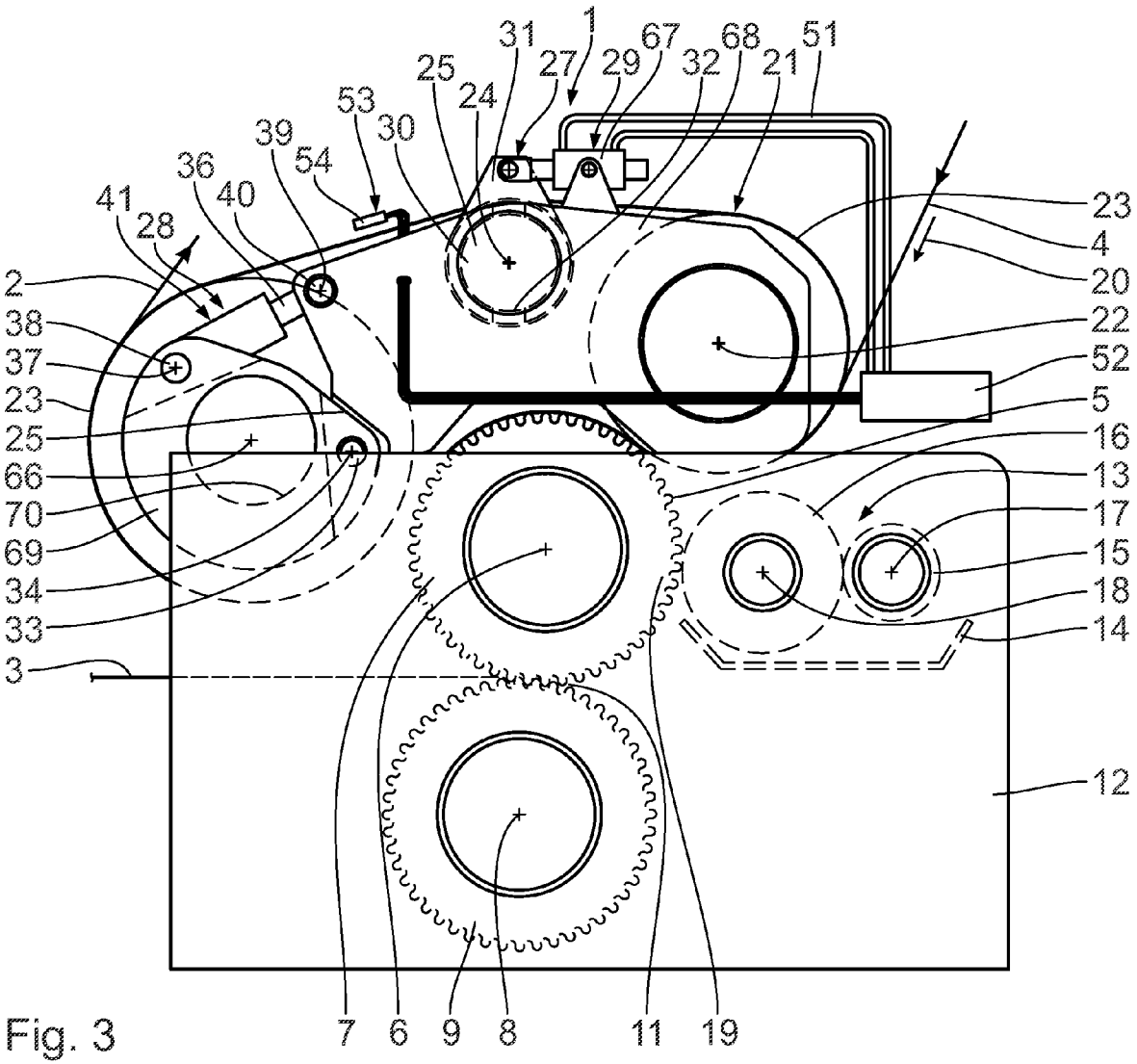
FIG. 3 shows a side view of an inventive embodiment according to a second embodiment.
Figure 4:
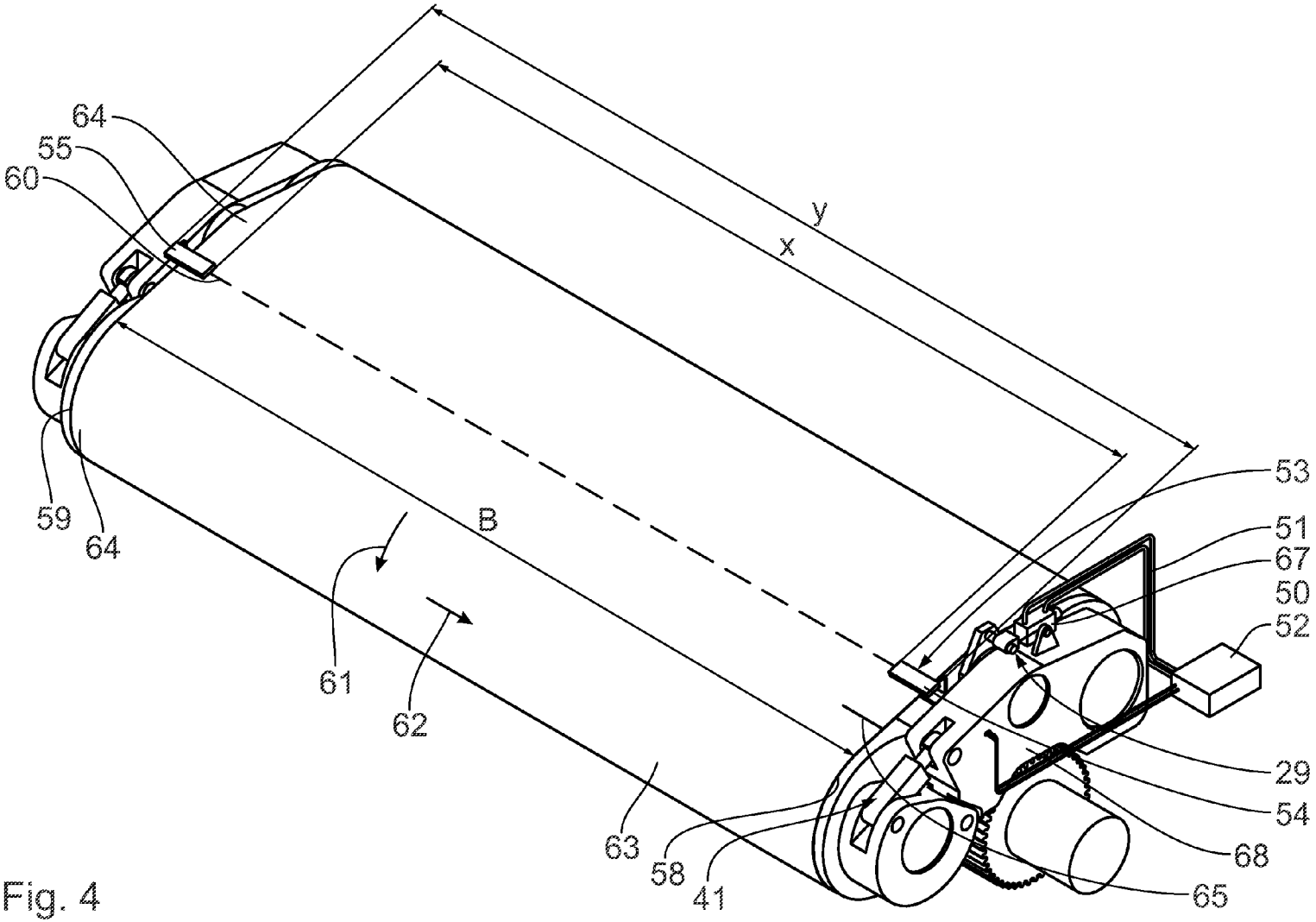
FIG. 4 shows a substantially perspective view of the pressure belt device of the assembly shown in FIG. 3.

A second embodiment of a pressure belt device 21 and an assembly 1 for producing a single-face laminated endless web 2 of corrugated cardboard is hereinafter descried with reference to FIGS. 3 and 4. Identical components are designated by the same reference numerals as used in the description of the first embodiment of the pressure belt device 21 which is explicitly referred to.

The assembly 1 for producing the single-face laminated web 2 of corrugated cardboard, which in turn forms part of a corrugated cardboard installation not shown, in turn comprises a first corrugating roller 7 and a second corrugating roller 9 which are arranged in pairs and extend parallel to each other so as to form a roller gap 11.

The assembly 1 for producing the single-face laminated web 2 of corrugated cardboard comprises a glue application device 13 arranged downstream of the corrugating rollers 7, 9 relative to the first material web 3 or the corrugated web 5, the glue application device 13 comprising a glue tray 14, a metering roller 15 arranged in the glue tray 14 and a glue application roller 16 arranged in the glue tray 14.

The assembly 1 for producing the single-face laminated web 2 of corrugated cardboard differs from the assembly 1 for producing the single-face laminated web 2 of corrugated cardboard shown in FIGS. 1 and 2 in the configuration of the pressure belt device 21. The pressure belt device 21 according to the second embodiment is again arranged downstream of the glue application device 13 and the roller gap 11 relative to the corrugated web 5. The pressure belt device 21 is disposed above the first corrugating roller 7.

The pressure belt device 21 has a first deflection roller 23 mounted for rotation about a fifth axis of rotation 22, and a belt course regulating roller 25 mounted for rotation about a sixth axis of rotation 24. In contrast to the embodiment illustrated in FIGS. 1 and 2, the pressure belt device 21 additionally has a second deflection roller 23 mounted for rotation about a seventh axis of rotation 66. The axes of rotation 22, 66 are always parallel to each other. They are also always parallel to the axes of rotation 6, 8. The deflection rollers 23 are preferably configured identically.

The belt course regulating roller 25 is arranged between the deflection rollers 23. The axis of rotation 24 of the belt course regulating roller 25 extends above the axes of rotation 22, 66 of the deflection rollers 23.

A driven endless pressure belt 26 is guided around the deflection rollers 23 and the belt course regulating roller 25.

The first corrugating roller 7 partly engages the space between the deflection rollers 23. This causes the pressure belt 26 to be deflected by the first corrugating roller 7 so as to be pressed against the endless second material web 4 which is thus pressed against the corrugated web 5 provided with glue, the corrugated web 5 abutting against the first corrugating roller 7. The belt course regulating roller 25 is arranged above the first corrugating roller 7. It is vertically spaced from the first corrugating roller 7.

The belt course regulating roller 25 is tiltable relative to the deflection rollers 23 about a tilting point which is preferably disposed in the center of its sixth axis of rotation 24. To this end, the pressure belt device 21 has a belt course regulating roller displacement device 27 comprising a belt course regulating displacement device 29 for changing the course or position of the pressure belt 26 by tilting the belt course regulating roller 25 relative to the deflection rollers 23.

The belt course regulating roller 25 has two near-end bearing pins 30 arranged opposite to each other which have a circular or annular cross-section. Each bearing pin 30 is mounted in a bearing body 31 comprising a bearing opening 32 adapted to the respective bearing pin 30 for rotation about the sixth axis of rotation 24 which therefore also forms a bearing axis or central longitudinal axis. The two bearing bodies 31 are preferably coupled to each other via a synchronous shaft (not shown) corresponding to the embodiment according to FIGS. 1 and 2.

In a position eccentric to the sixth axis of rotation 24, one of the bearing bodies 31 is engaged by a length-adjustable, in other words telescopable, actuating drive 67 in such a way that a lever assembly is formed. When the actuating drive 67 is actuated, the length thereof changes, thus causing the bearing body 31 coupled therewith to be pivoted. Owing to the coupling of the two bearing bodies 31 provided by the synchronous shaft, the two bearing bodies 31 are pivoted relative to each other in opposite directions, thus causing the belt course regulating roller 25 to be tilted about the tilting point. The bearing bodies 31 are pivoted to the same extent in terms of their absolute values. In other words, if one bearing body 31 is moved upwards, this causes the other bearing body 31 to be moved downwards by the same distance because of the coupling provided therebetween. The actuating drive 67 is in signal communication with a pressure belt regulating device 52 via a signal line 51.

The actuating drive 67 forming a belt course actuating device is mounted, in particular pivotably, to a side member 68 of the pressure belt device 21. The first deflection roller 23 is also mounted for rotation in the two side members 68 of the pressure belt device 21.

Each side member 68 is provided with a length-adjustable belt tensioning actuating means 36. Together, the two belt-tensioning actuating means 36 form a belt tensioning actuating device 41. The belt tensioning actuating means 36 are preferably telescopable. Each belt tensioning actuating means 36 is articulated to a bearing member 69 via a coupling body 38 defining a second pivot axis 37. Furthermore, each belt tensioning actuating means 36 is articulated to the respective side member 68 via a coupling body 40 defining a third pivot axis 39.

Each bearing member 69 is further articulated to the respective side member 68 via pivot bodies 33. The pivot bodies 33 and the coupling bodies 48 of each bearing member 69 are spaced from a bearing opening 70 for mounting the second deflection roller 23.

Furthermore, the pivot bodies 33 of each side member 68 are spaced from the coupling bodies 40. The pivot axes 34, 37, 39 are parallel to each other.

The pressure belt regulating device 50 is in signal communication with the belt tensioning actuating means 36 via a signal line (not shown).

When the two belt tensioning actuating means 36 are actuated evenly, the bearing members 69 are pivoted relative to the side members 68 about the first pivot axis 34. As a result, the distance of the deflection rollers 23 changes in an even and uniform manner along the length thereof, which in turn causes the tension in the pressure belt 26 to change. When the second deflection roller 23 is moved away from the belt course regulating roller 25 or the first deflection roller 23, the tension in the pressure belt 26 is increased. Conversely, when the second deflection roller 23 is moved towards the first deflection roller 23 or the belt course regulating roller 25, the tension in the pressure belt 26 is reduced.

Again, the pressure belt device 21 further comprises a pressure belt detection device 53 which corresponds to the embodiment according to FIGS. 1, 2. Regulation of the pressure belt 26 is substantially equal to the embodiment according to FIGS. 1, 2. When the pressure belt 26 is laterally offset from its desired position, the belt course regulating roller 25 is displaced via the belt course regulating displacement device 29 of the belt course regulating roller displacement device 27, strictly speaking the actuating drive 67, until the pressure belt 26 is in its desired position again. The deflection rollers 23 remain parallel to each other.

Again, an identification thread 65 is detectable by the first pressure belt detection means 54.

What is claimed is:

1. An assembly for producing an at least single-face laminated endless web of corrugated cardboard, the assembly comprising:

a first corrugating roller and a second corrugating roller for producing a corrugated web having a corrugation;

a glue application device for applying glue to tips of the corrugation of the corrugated web; and a pressure belt device comprising a deflection roller, a belt course regulating roller and an endless pressure belt guided around the deflection roller and the belt course regulating roller for pressing a cover layer against the tips, provided with glue, of the corrugated web partly abutting against the first corrugating roller, the pressure belt comprising a first outer endless side edge, a second outer endless side edge arranged opposite to the first outer endless side edge, a direction of rotation, and a transverse direction extending transversely to the direction of rotation, said pressure belt device further comprising a belt course regulating roller displacement device for displacing the belt course regulating roller, a position of the pressure belt being changeable in the transverse direction thereof by displacing the belt course regulating roller, said pressure belt device further comprising at least one pressure belt detection device associated with the pressure belt for detecting the position of the pressure belt in the transverse direction, the pressure belt detection device comprising a first pressure belt detection means for detecting the position of the first outer endless side edge of the pressure belt in the transverse direction thereof, said pressure belt device further comprising a pressure belt regulating device which is in signal communication with the pressure belt detection device and receives positional information concerning the position of the pressure belt in the transverse direction thereof, said pressure belt device further comprising at least one actuating device connected to the belt course regulating roller displacement device for displacing the belt course regulating roller depending on regulating signals received from the pressure belt regulating device, the pressure belt detection device further comprising a second pressure belt detection means for detecting the position of the second outer endless side edge of the pressure belt in the transverse direction thereof, the pressure belt regulating device being configured to calculate an actual width of the pressure belt in the transverse direction thereof based on the positional information concerning the two detected outer endless side edges, wherein said pressure belt regulating device is further configured to one of actuate and displace the pressure belt based on the calculated width.

2. An assembly according to claim 1, wherein the pressure belt detection device is a contactless pressure belt detection device.

3. An assembly according to claim 1, wherein the pressure belt includes metal material.

4. An assembly according to claim 3, wherein the pressure belt is substantially entirely made of metal material.

5. An assembly according to claim 1, wherein the pressure belt comprises at least one identifier detectable by the pressure belt detection device for setting at least one parameter required for the pressure belt used.

6. An assembly according to claim 5, wherein the pressure belt comprises an identifier in the form of a detectable identification thread.

7. An assembly according to claim 5, wherein the at least one parameter required for the pressure belt used is set by means of the belt course regulating roller displacement device.

8. An assembly according to claim 1, wherein the first pressure belt detection means extends above or below a first outer endless side edge region of the pressure belt adjoining the first outer endless side edge, said first pressure belt detection means extending beyond the first endless outer side edge in a laterally outward direction for detecting a prevailing first overlap with the pressure belt.

9. An assembly according to claim 8, wherein the first pressure belt detection means extends in the transverse direction of the pressure belt.

10. An assembly according to claim 1, wherein the second pressure belt detection means extends above or below a second outer endless side edge region of the pressure belt adjoining the second outer endless side edge, the second pressure belt detection means extending beyond the first outer endless side edge in a laterally outward direction for detecting a prevailing second overlap with the pressure belt.

11. An assembly according to claim 1, wherein the second pressure belt detection means extends in the transverse direction of the pressure belt.

12. An assembly according to claim 1, wherein the first pressure belt detection means and the second pressure belt detection means are arranged on an imaginary straight line which runs in the transverse direction of the pressure belt.

13. An assembly according to claim 1, wherein the pressure belt regulating device one of actuates and displaces the pressure belt depending on the calculated width.

14. An assembly according to claim 1, wherein the pressure belt regulating device determines the service life stage of the pressure belt on the basis of the actual width of the pressure belt of the pressure belt in the transverse direction thereof.

15. An assembly according to claim 1, wherein the pressure belt regulating device calculates the actual width of the pressure belt from a known distance of the two pressure belt detection means from each other in the transverse direction of the pressure belt and from the actual overlaps of the two pressure belt detection means with the pressure belt.

16. An assembly according to claim 1, wherein a difference of the two overlaps of the pressure belt detection means with the pressure belt results in a transverse offset of the pressure belt in the transverse direction thereof.

17. An assembly according to claim 16, wherein the pressure belt regulating device actuates the at least one actuating device in such a way that the difference of the two overlaps of the pressure belt detection means with the pressure belt equals zero.

18. An assembly according to claim 17, wherein a center regulation of the pressure belt is carried out.

19. An assembly according to claim 1, wherein exactly one belt course regulating roller and exactly one deflection roller are provided, the belt course regulating roller being tiltable relative to the deflection roller to change the course of the pressure belt in the transverse direction thereof while the distance thereof from the deflection roller is changeable for changing the tension in the pressure belt.

20. An assembly according to claim 1, wherein exactly one belt course regulating roller and two deflection rollers are provided, the belt course regulating roller being tiltable relative to the deflection rollers for changing the course of the pressure belt in the transverse direction thereof while a distance between the deflection rollers is changeable for changing the tension in the pressure belt.

21. A method for producing an at least single-face laminated endless web of corrugated cardboard, the method comprising:

providing a first corrugating roller and a second corrugating roller for producing a corrugated web having a corrugation;

providing a glue application device for applying glue to tips of the corrugation of the corrugated web;

providing a pressure belt device comprising a deflection roller, a belt course regulating roller and an endless pressure belt guided around the deflection roller and the belt course regulating roller for pressing a cover layer against the tips, provided with glue, of the corrugated web partly abutting against the first corrugating roller, the pressure belt comprising a first outer endless side edge, a second outer endless side edge arranged opposite to the first outer endless side edge, a direction of rotation, and a transverse direction running transversely to the direction of rotation, said pressure belt device further comprising a belt course regulating roller displacement device for displacing the belt course regulating roller, a position of the pressure belt being changeable in the transverse direction thereof by displacing the belt course regulating roller, said pressure belt device further comprising at least one pressure belt detection device associated with the pressure belt for detecting the position of the pressure belt in the transverse direction, the pressure belt detection device comprising a first pressure belt detection means for detecting the position of the first outer endless side edge of the pressure belt in the transverse direction thereof, said pressure belt device further comprising a pressure belt regulating device which is in signal communication with the pressure belt detection device and receives positional information concerning the position of the pressure belt in the transverse direction thereof, said pressure belt device further comprising at least one actuating device connected to the belt course regulating roller displacement device for displacing the belt course regulating roller depending on regulating signals received from the pressure belt regulating device, the pressure belt detection device further comprising a second pressure belt detection means for detecting the position of the second outer endless side edge of the pressure belt in the transverse direction thereof;

calculating an actual width of the pressure belt in the transverse direction thereof based the positional information concerning the two detected outer endless side edges; and one of actuating and displacing the pressure belt based on the calculated width.

* * * * *